US008451494B2

(12) United States Patent
Yamazaki

(10) Patent No.: US 8,451,494 B2
(45) Date of Patent: May 28, 2013

(54) IMAGE FORMING APPARATUS

(75) Inventor: Masataka Yamazaki, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 697 days.

(21) Appl. No.: 12/626,196

(22) Filed: Nov. 25, 2009

(65) Prior Publication Data

US 2010/0134813 A1 Jun. 3, 2010

(30) Foreign Application Priority Data

Nov. 28, 2008 (JP) ..... 2008-304184

(51) Int. Cl.
*G06F 15/00* (2006.01)

(52) U.S. Cl.
USPC ..... 358/1.9; 358/518; 348/231.99

(58) Field of Classification Search
None
See application file for complete search history.

(56) References Cited

U.S. PATENT DOCUMENTS

| | | | | |
|---|---|---|---|---|
| 5,694,637 | A | 12/1997 | Yoshino et al. | |
| 5,872,586 | A | 2/1999 | Shio | |
| 2004/0012694 | A1* | 1/2004 | Sato | 348/231.99 |
| 2005/0047834 | A1 | 3/2005 | Tomita et al. | |
| 2008/0043299 | A1* | 2/2008 | Ikeda | 358/518 |

FOREIGN PATENT DOCUMENTS

| | | |
|---|---|---|
| EP | 1 424 609 A2 | 6/2004 |
| JP | 9-76558 | 3/1997 |
| JP | 10-3188 | 1/1998 |
| JP | 2003-195603 | 7/2003 |
| JP | 2004-142250 | 5/2004 |
| JP | 2004-252172 | 9/2004 |
| JP | 2008-77066 | 4/2008 |

OTHER PUBLICATIONS

Extended European Search Report dated Dec. 8, 2010 from related European Application No. 09252686.2.

* cited by examiner

*Primary Examiner* — Twyler Haskins
*Assistant Examiner* — Helen Q Zong
(74) *Attorney, Agent, or Firm* — Scully, Scott, Murphy & Presser, PC

(57) ABSTRACT

An image forming apparatus includes a carrier; a forming unit that forms a pattern on the carrier; a correcting unit that executes a plurality of correction processes for image formation by measuring the pattern formed on the carrier by the forming unit; and an issuing unit that has issuing conditions corresponding to the correction processes and issues execution requests indicating execution timings of the correction processes satisfying the issuing conditions, wherein the correcting unit executes only one correction process, of which the execution request is issued, when another correction process is not issued at the execution timing of the one correction process, and wherein the correcting unit executes the one correction process and the another correction process in a prescribed order regardless of the execution timings indicated by the execution requests when the another correction process is issued at the execution timing of the one correction process.

5 Claims, 7 Drawing Sheets

IMAGE FORMING APPARATUS

CROSS REFERENCE TO RELATED APPLICATION

The present application claims priority from Japanese Patent Application No. 2008-304184, which was filed on Nov. 28, 2008, the disclosure of which is herein incorporated by reference in its entirety.

TECHNICAL FIELD

Apparatuses and devices consistent with the present invention relate to an image forming apparatus.

BACKGROUND

The image forming apparatus includes: a plurality of correction processes for image formation such as a static deviation correction process of correcting static positional deviation caused from deviation in mounting positions of components (optical components of an exposure unit, a photosensitive drum, and the like) of the image forming unit; a dynamic deviation correction process of correcting dynamic positional deviation with a specific period caused by aberration in eccentricity of rollers for supporting a belt and a photosensitive drum and aberration in pitch of gear for rotating those; a density correction process; and the like.

For example, a related art image forming apparatus is configured so that the static deviation correction process has to be performed after the dynamic deviation correction process and both correction processes are set as one set and continuously performed in this order.

SUMMARY

However, in the related art image forming apparatuses, there is a problem in that always the two correction processes are performed as one set even when only any one of the correction processes is needed. Nevertheless, it is not preferable to totally neglect the above order. Furthermore, such a problem is not limited to the positional deviation correction process, and may also arise in other correction processes such as the density correction process in the same manner.

The invention has been made in view of the situation mentioned above, and its object is to provide an image forming apparatus capable of executing a plurality of correction processes independent of each other while suppressing departing from a prescribed order.

According to an illustrative aspect of the present invention, there is provided an image forming apparatus comprising: a carrier; a forming unit that forms a pattern on the carrier; a correcting unit that executes a plurality of correction processes for image formation by measuring the pattern formed on the carrier by the forming unit; and an issuing unit that has issuing conditions corresponding to the correction processes and issues execution requests indicating execution timings of the correction processes satisfying the issuing conditions, wherein the correcting unit executes only one correction process, of which the execution request is issued, when another correction process is not issued at the execution timing of the one correction process, and wherein the correcting unit executes the one correction process and the another correction process in a prescribed order regardless of the execution timings indicated by the execution requests when the another correction process is issued at the execution timing of the one correction process.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Hereinafter, an embodiment of the invention will be described with reference to the accompanying drawings.

Overall Configuration of Printer

Figure 1:
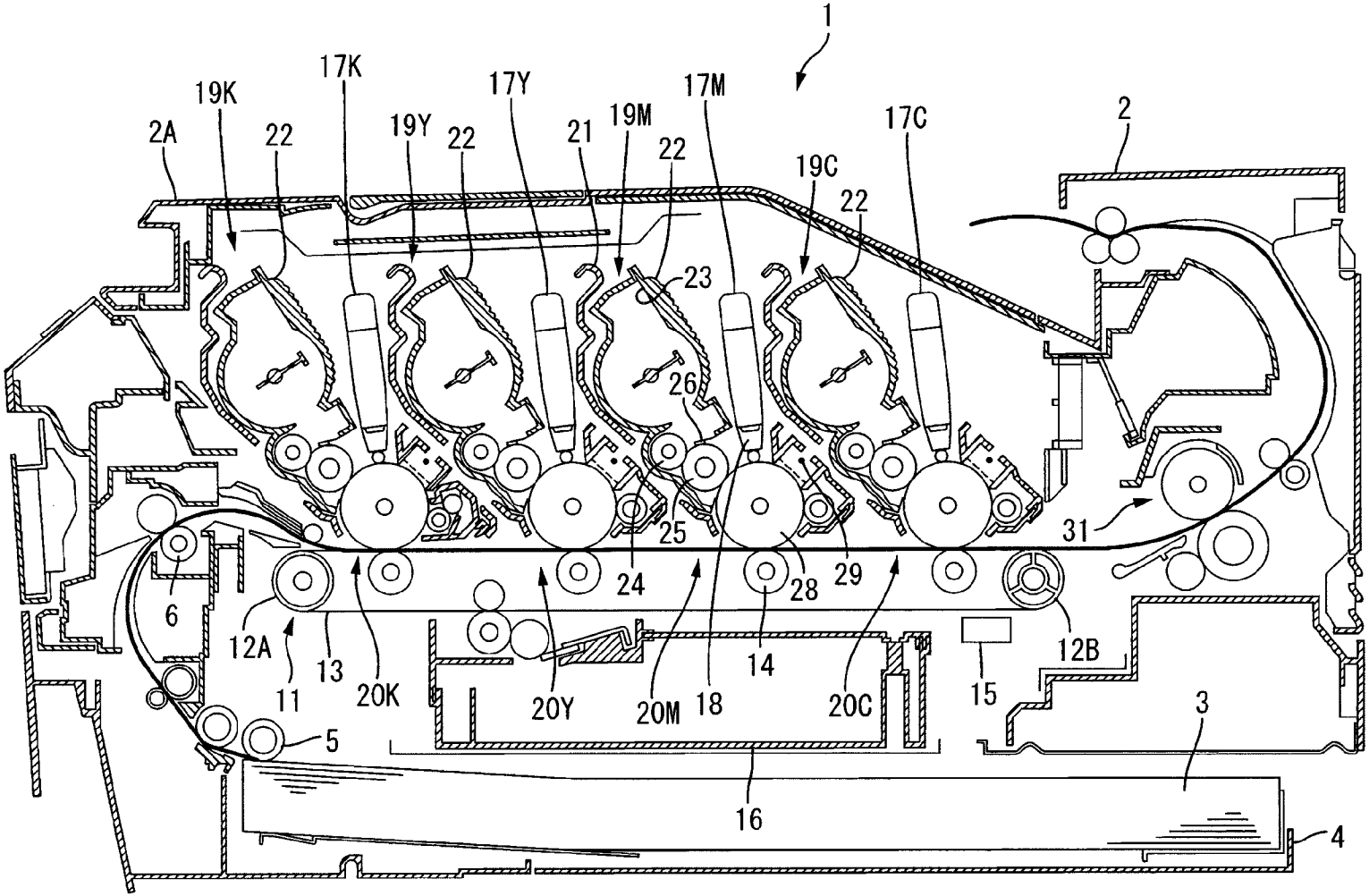
FIG. 1 is a sectional side view illustrating a schematic structure of a printer according to an embodiment of the invention.

FIG. 1 is a sectional side view illustrating a schematic structure of a printer 1 as one example of an image forming apparatus according to an embodiment of the invention. The printer 1 is a direct-tandem-type color printer which forms color images by using toners of, for example, four colors (black K, yellow Y, magenta M, and cyan C). In the following description, the left side of FIG. 1 shows the front. Additionally, in FIG. 1, the reference numerals and signs of the same components among the colors are appropriately omitted.

The printer 1 includes a casing 2, and a cover 2A, which is openable, is provided on the upper surface thereof. On the bottom of the casing 2, a feed tray 4 on which a plurality of sheets 3 (as one example of image forming media such as paper sheets) can be stacked is provided. Above the front end of the feed tray 4, there is provided a feed-out roller 5 to deliver, along the rotation of the feed-out roller 5, the sheets 3 stacked on the uppermost in the feed tray 4 to a registration roller 6. After performing skew correction of the sheets 3, the registration roller 6 then delivers the sheets 3 onto a belt unit 11.

The belt unit 11 is configured so that a loop belt 13 (as one example of the "carrier" according to the aspect of the invention) made of polycarbonate is stretched between a belt supporting roller 12A disposed on the front and a belt driving roller 12B disposed on the rear. Inside the belt 13, a transfer roller 14 is provided on a position opposed to processing units 19K to 19C to be described later with the photosensitive drum 28 and the belt 13 interposed therebetween. The belt unit 11 is detachable from the casing 2 in a state where the processing units 19K to 19C are detached by opening the cover 2A of the casing 2.

The belt driving roller 12B is connected to a driving motor 47 (see FIG. 2) provided in the casing 2 with a unillustrated gear mechanism interposed therebetween in a state where the belt unit 11 is mounted on the casing 2. Then, the belt driving roller 12B is rotated by the dynamic force of the driving motor 47, and thus the belt 13 is looped in the clockwise direction shown in the drawing. Thereby, the sheet 3 statically attached onto the surface of the belt 13 is conveyed rearwardly.

Furthermore, a pattern detecting sensor 15 for detecting a pattern and the like formed on the belt 13 is provided on a position opposed to the bottom surface of the belt 13. The pattern detecting sensor 15 receives a light, which is emitted from a light source and reflected on the belt 13, by using photo diodes, and outputs an electrical signal corresponding to the intensity of the received light. Also, on the lower side of the belt unit 11, there is provided a cleaning device 16 for collecting toner, paper chips, and the like adhered to the surface of the belt 13.

Above the belt unit 11, there are serially arranged four exposure units 17K, 17Y, 17M, and 17C, and four processing units 19K, 19Y, 19M, and 19C in the horizontal direction. The exposure units 17K to 17C, the processing units 19K to 19C, and the above-mentioned transfer rollers 14 respectively constitute four sets of image forming units 20K, 20Y, 20M, and 20C (as one example of the "forming unit" according to the aspect of the invention). The entire system of the printer 1 is provided with the four image forming units 20K, 20Y, 20M, and 20C corresponding to the colors of black, yellow, magenta, and cyan.

Each of the exposure units 17K to 17C is supported on the bottom surface of the cover 2A, and respectively has LED heads 18 on the lower end thereof. The LED heads 18 include a plurality of LEDs arranged in series. Each of the exposure units 17K to 17C is controlled to emit light on the basis of image data to be formed, and irradiates the light onto each one line on the surface of a photosensitive drum 28 corresponding to the LED head 18, thereby performing the exposure process.

Each of the processing units 19K to 19C includes a cartridge frame 21 and a developing cartridge 22 detachably mounted on the cartridge frame 21. When the cover 2A is released, each of the exposure units 17K to 17C moves upwardly along with the cover 2A, and thus each of the processing units 19K to 19C becomes detachable from the casing 2.

The developing cartridge 22 includes a toner storing chamber 23 for storing toner of each color as a developer, and at the lower side thereof, includes a feed roller 24, a developing roller 25, a thickness regulating blade 26, and the like. The toner discharged from the toner storing chamber 23 is fed to the developing roller 25 due to the rotation of the feed roller 24, and is triboelectrically-charged to be positive between the feed roller 24 and the developing roller 25. Furthermore, the toner fed onto the developing roller 25, along with the rotation of the developing roller 25, moves into the gap between the thickness regulating blade 26 and the developing roller 25 so as to be more sufficiently triboelectrically-charged there, thereby being held on the developing roller 25 as a thin-layer having a constant thickness.

In the lower part of the cartridge frame 21, there are provided the photosensitive drum 28 (one example of a photoreceptor), with its surface covered by a photosensitive layer of a positive charge type, and a scorotron type charger 29. At the time of image formation, the photosensitive drum 28 is rotationally driven, and thus the surface of the photosensitive drum 28 is uniformly charged to be positive by the charger 29. Then, the positively-charged part is exposed by the scanning of the exposure units 17K to 17C, and an electrostatic latent image is formed on the surface of the photosensitive drum 28.

Next, the positively charged toner, which is held by the developing roller 25, is supplied to the electrostatic latent image of the surface of the photosensitive drum 28, and thus the electrostatic latent image on the photosensitive drum 28 is visualized. Then, while the sheets 3 pass through each of the nip positions between the photosensitive drums 28 and the transfer rollers 14, the toner image held on the surface of each of the photosensitive drums 28 is sequentially transferred to the sheet 3 by the negative transfer voltage applied to the transfer roller 14. The sheet 3, on which the toner image transferred, is conveyed to the fixer 31, and the toner image is thermally fixed therein. Then, the sheet 3 is conveyed upwardly, and is discharged to the surface of the cover 2A.

Electrical Configuration of Printer

Figure 2:
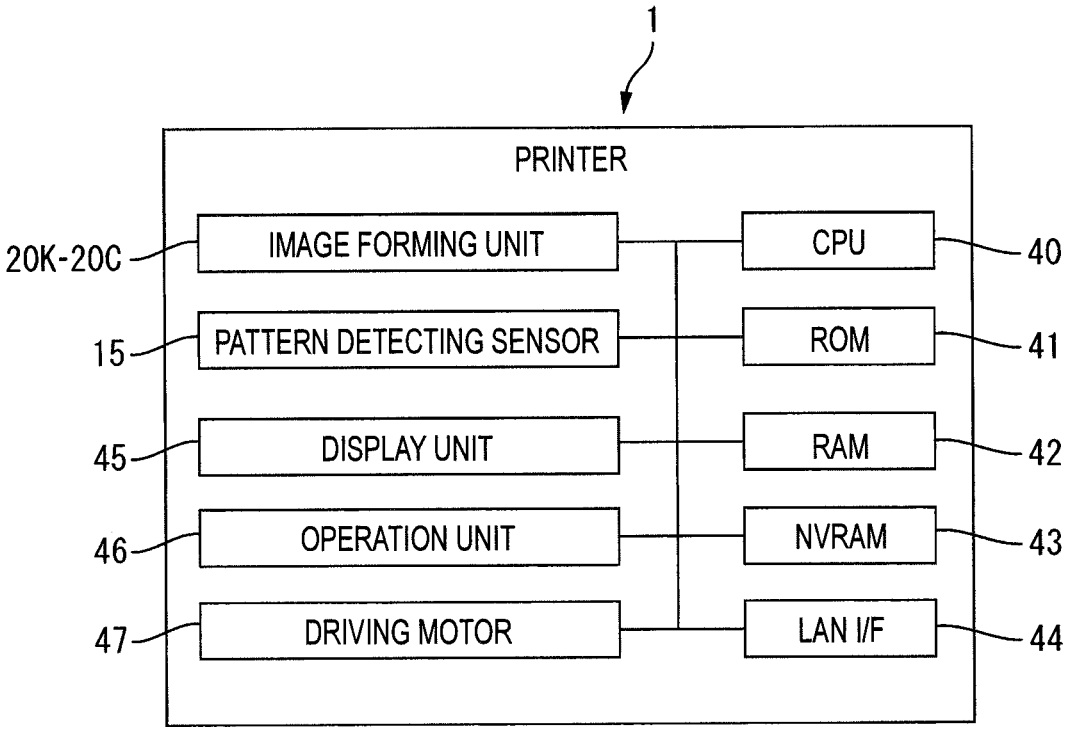
FIG. 2 is a block diagram schematically illustrating an electrical configuration of the printer.

FIG. 2 is a block diagram schematically illustrating an electrical configuration of the printer 1.

As shown in the drawing, the printer 1 includes a CPU 40, a ROM 41, a RAM 42, a NVRAM (nonvolatile memory) 43, and a network interface 44. Those are connected to the above-mentioned image forming units 20K to 20C, the pattern detecting sensor 15, the display unit 45, an operation unit 46, a driving motor 47, and the like.

Stored in the ROM 41 are programs for performing operations of the printer 1 such as the various correction process to be described later. In accordance with these programs read out from the ROM 41, the CPU 40 performs controls for each unit, while at the same time, storing the processing results in the RAM 42 or the NVRAM 43. The network interface 44 is connected to the external computer (not shown) and the like via a communication line, and this enables the interactive data communication.

The display unit 45 includes a liquid crystal display and lamps, and is able to display various setting screens and operational states of the apparatus. The operating unit 46 includes a plurality of buttons which allow the user to perform various inputting operations. The driving motor 47 is formed of a plurality of motors, and rotates the above-mentioned registration roller 6, the belt driving roller 12B, the developing roller 25, the photosensitive drum 28, and the like through a gear mechanism which is not shown.

Various Correction processes

The CPU 40 is able to perform a dynamic correction process, a static correction process, a development bias correction process, and a gamma correction process. At this time, the CPU 40 functions as the "correcting unit" according to the aspect of the invention. These correction processes are performed on the basis of a static correction value, a dynamic correction value, a bias correction value, and a gamma correction value respectively stored in the NVRAM 43.

(1) Dynamic Correction Process

Figure 3:
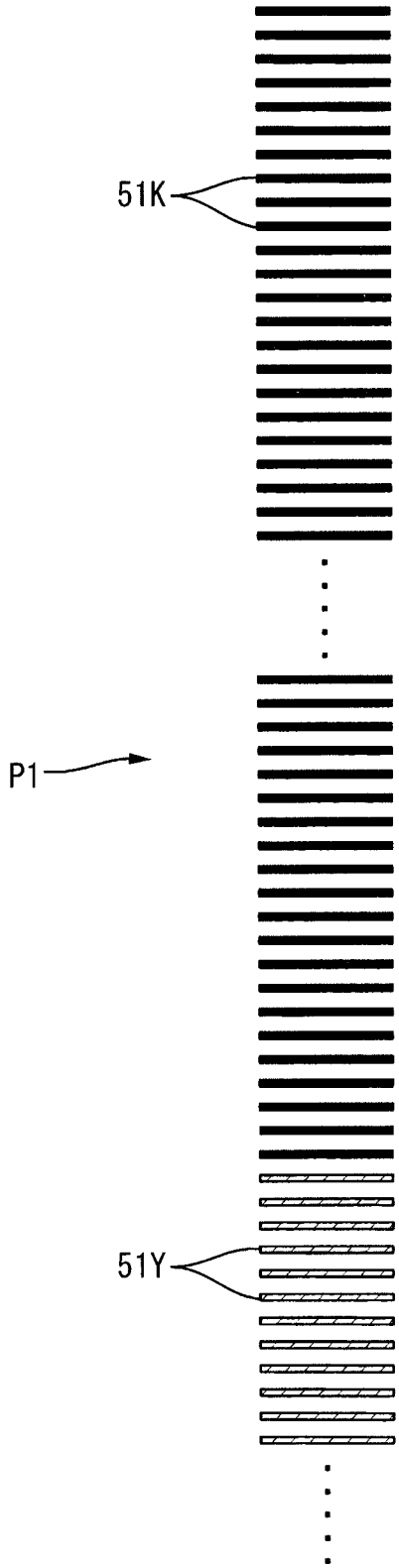
FIG. 3 is a diagram illustrating a pattern for dynamic detection.

FIG. 3 is a diagram illustrating a pattern P1 for dynamic detection.

The dynamic correction process is a process for correcting deviation in dynamic image formation position occurring in a specific period. When starting the dynamic correction process, the CPU 40 forms the pattern P1 for dynamic detection on the belt 13 by use of the image forming units 20K to 20C. Here, the static correction value, the dynamic correction value, and the bias correction value stored in the NVRAM 43 are read, and the development bias value (a voltage value) applied to the developing rollers 25 is changed on the basis of the bias correction value, thereby correcting the density of the pattern P1. Furthermore, on the basis of the static correction value and dynamic correction value, timings of writing the lines are corrected. With such a configuration, on the basis of the static correction value, the dynamic correction value, and the bias correction value most recently stored in the NVRAM 43, the pattern P1 is formed with the static positional deviation, the dynamic positional deviation, and the density deviation corrected.

In the pattern P1 for dynamic detection, as shown in FIG. 3, the respective color marks 51K and 51Y (here, only black and yellow are illustrated), which are long and thin in a main scanning direction (a widthwise direction of the belt 13), are arranged in a sub-scanning direction (a moving direction of the belt 13) in accordance with the respective colors. Intervals of the adjacent concolor marks 51K and 51Y are configured to be the same when the respective marks 51K and 51Y are formed on ideal positions at which no positional deviation occurs. Further, when an amount of the dynamic positional deviation caused by rotational deviation of the photosensitive drum 28 is detected, a length of the groups of the respective color marks 51K and 51Y in the sub-scanning direction is larger than at least a circumferential length of the photosensitive drum 28. For example, the length is integer times the circumferential length of the photosensitive drum 28.

Subsequently, the CPU 40 measures times at which the respective color marks 51K and 51Y passes a detection position of the pattern detecting sensor 15 on the basis of a signal transmitted from the pattern detecting sensor 15. On the basis of the result, the CPU 40 detects an amount of positional deviation with a period which coincides with a rotational period of the photosensitive drum 28. More specifically, the rotational period of the photosensitive drum 28 is divided into a plurality of units, and the deviation amounts are obtained from the ideal positions of the marks 51K and 51Y corresponding to the respective units, thereby setting an average value of those to an amount of the dynamic positional deviation of the unit. Then, by adding a correction value for offsetting the amount of the dynamic positional deviation to the dynamic correction value of the corresponding unit stored in the NVRAM 43 and the like, the value is updated, and the dynamic correction process is terminated.

(2) Static Correction Process

Figure 4:
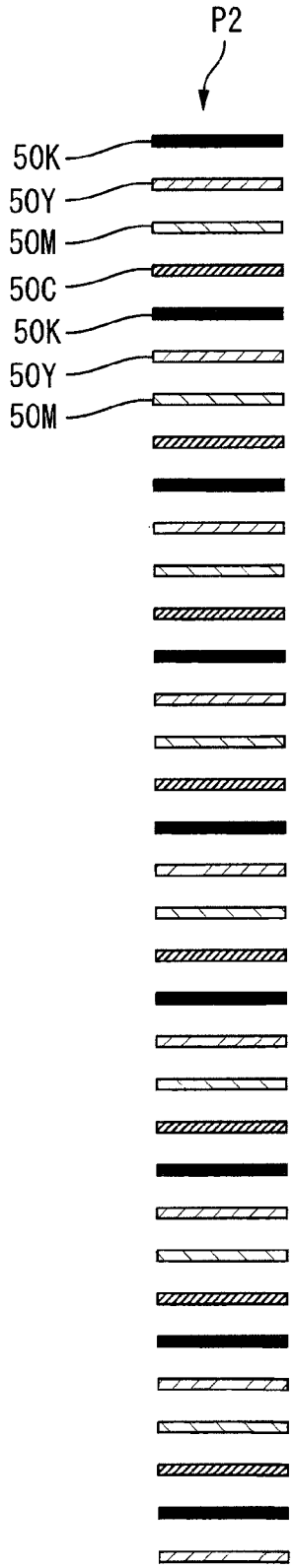
FIG. 4 is a diagram illustrating a pattern for static detection.

FIG. 4 is a diagram illustrating a pattern P2 for static detection.

The static correction process is a process for correcting deviation in static image formation position. When starting the static correction process, the CPU 40 forms the pattern P2 for static detection on the belt 13 by use of the image forming units 20K to 20C. Here, the static correction value, the dynamic correction value, and the bias correction value stored in the NVRAM 43 are read, and the development bias value applied to the developing rollers 25 is changed on the basis of the bias correction value, thereby correcting the density of the pattern P2. Furthermore, on the basis of the static correction value and the dynamic correction value, timings of writing the lines are corrected. With such a configuration, on the basis of the static correction value, the dynamic correction value, and the bias correction value most recently stored in the NVRAM 43, the pattern P2 is formed with the static positional deviation, the static positional deviation, and the density deviation corrected.

The pattern P2 for static detection is, as shown in FIG. 4, formed of the respective color marks 50K, 50Y, 50M, and 50C which are long and thin in the main scanning direction. The four marks 50K to 50C, which are arranged in order of black, yellow, magenta, and cyan, are formed as one group, and the plural groups of the marks 50K to 50C are arranged in the range of the entire circumference of the belt 13 with intervals in the sub-scanning direction. Intervals of the adjacent marks 50K to 50C are configured to be the same when the respective marks 50K to 50C are foil led on ideal positions at which no positional deviation occurs. In the pattern P2, the intervals of adjacent marks 50K to 50C are larger than those of the respective marks 51K and 51Y of the pattern P1 for dynamic correction. Further, a length of the pattern P2 in the sub-scanning direction is larger than at least a circumferential length of the photosensitive drum 28. For example, the length is integer times the circumferential length of the photosensitive drum 28.

Subsequently, the CPU 40 measures, for the respective groups of the marks 50K to 50C, times at which the respective color marks 50K to 50C passes a detection position of the pattern detecting sensor 15 on the basis of a signal transmitted from the pattern detecting sensor 15. On the basis of the result, when the mark 50K of black (which is referred to as a reference color) is set as a reference, the CPU 40 detects amounts of positional deviation of the marks 50Y, 50M, and 50C of different colors (which are referred to as correction colors) in the sub-scanning direction. Then, regarding the positional deviation amounts of the correction colors, average values of the whole groups are respectively calculated, and values for offsetting the average values of the positional deviation are added to the static correction values of the correction colors stored in the NVRAM 43 and the like. In such a manner, the values are updated (S204), and the static correction process is terminated.

(3) Development Bias Correction Process

The development bias correction process is a process for correcting deviation between an ideal density designated by the CPU 40 of the printer 1 and a density of the pattern actually formed by the image forming units 20K to 20C. The CPU 40 forms the density pattern (not shown in the drawing) on the belt 13 by use of the image forming units 20K to 20C. Here, the static correction value, the dynamic correction value, and the bias correction value stored in the NVRAM 43 are read, and the development bias value applied to the developing rollers 25 is changed on the basis of the bias correction value, thereby correcting the density of the density pattern. Furthermore, on the basis of the static correction value and dynamic correction value, timings of writing the lines are corrected. With such a configuration, on the basis of the static correction value, the dynamic correction value, and the bias correction value most recently stored in the NVRAM 43, the density pattern is formed with the static positional deviation, the dynamic positional deviation, and the density deviation corrected.

Here, the used density pattern has, for example, density marks having predetermined densities (for example, 100%) corresponding to the respective colors. The CPU 40 measures the densities of the density marks on the basis of the light receiving amounts detected in the pattern detecting sensor 15. On the basis of the result, the CPU 40 calculates the bias correction value at which the density of the formed image is approximate to the ideal density, thereby updating the value.

(4) Gamma Correction Process

The gamma correction process is a process for correcting deviation between a density (a designated tone) designated by the external computer and an output density of the printer 1. The CPU 40 forms a tonal pattern (not shown in the drawing) on the belt 13 by use of the image forming units 20K to 20C. Here, the static correction value, the dynamic correction value, and the bias correction value stored in the NVRAM 43 are read, and the development bias value applied to the developing rollers 25 is changed on the basis of the bias correction value, thereby correcting the density of the tonal pattern. Furthermore, on the basis of the static correction value and dynamic correction value, timings of writing the lines are corrected. With such a configuration, on the basis of the static correction value, the dynamic correction value, and the bias correction value most recently stored in the NVRAM 43, the tonal pattern is formed with the static positional deviation, the dynamic positional deviation, and the density deviation corrected.

Here, the used tonal pattern has, for example, a plurality of marks, of which densities are different for each density interval (for example, 20%), corresponding to the respective colors. The CPU 40 measures the densities of the marks on the basis of the light receiving amounts detected in the pattern detecting sensor 15, and specifies density change characteristics of the colors from a relationship among the densities of the marks. On the basis of the result, the CPU 40 generates a relationship table about a relationship between the change characteristics and the tones designated by the external computer.

Issuing Conditions and Execution Timings of Execution Requests of Correction Processes The issuing conditions of the execution requests of the correction processes and the execution timings designated by the execution request are as follows. In addition, the types of the execution timings are, for example, as follows.

"Immediate execution": an execution immediately performed when the issuing condition is satisfied.

Figure 5:
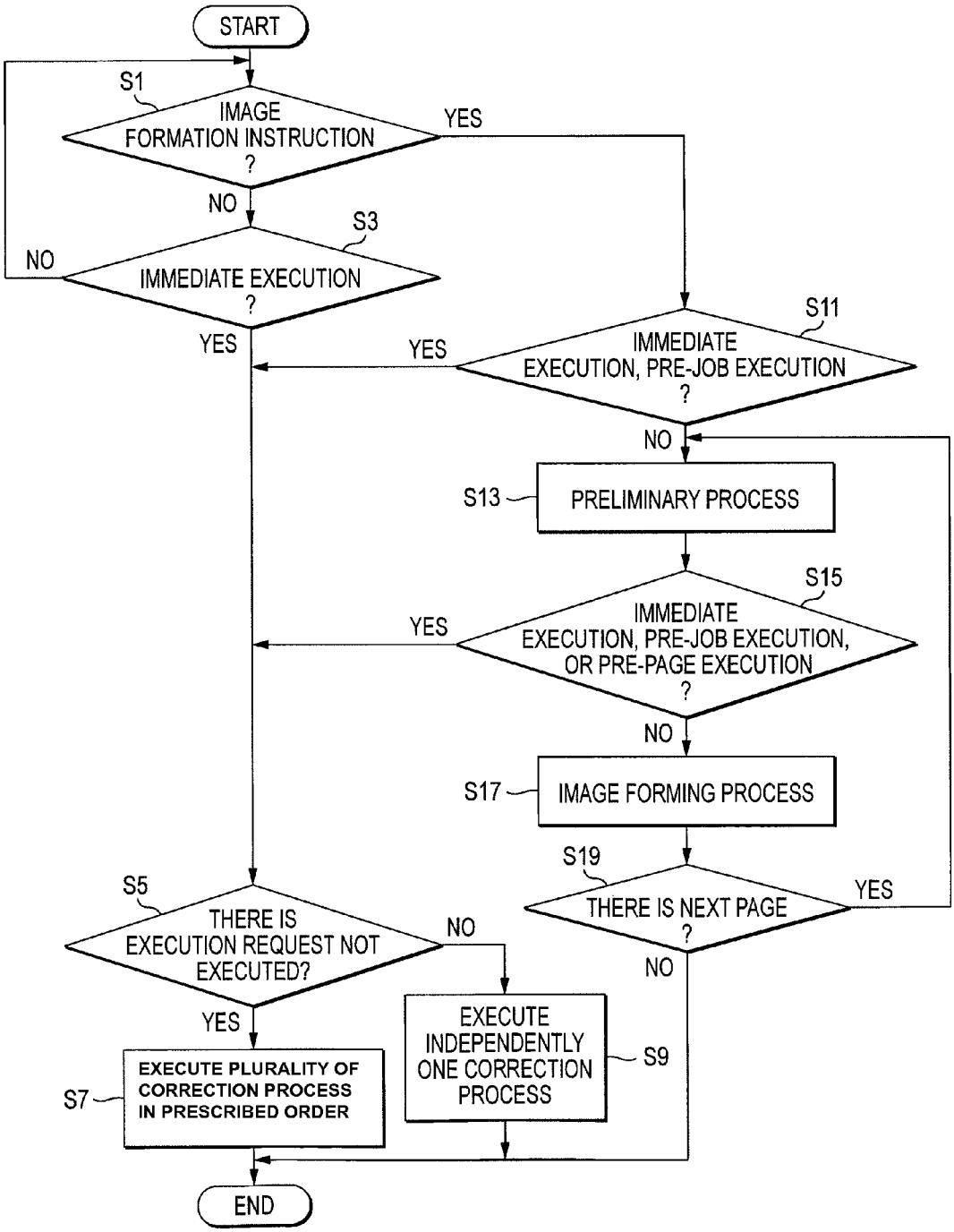
FIG. 5 is a flowchart illustrating a correction control process.

"Pre-job execution": an execution performed before an image forming process for a print job is started after image formation instruction (more specifically, an execution performed before a preliminary process (S13) of FIG. 5).

"Pre-page execution": an execution performed before the image forming process (S17 of FIG. 5) is started for each page in the process of the print job. More specifically, the execution is performed before the image forming process of the first page after the image formation instruction, before the image forming process of the second page after the image forming process of the first page, before the image forming process of the fourth page after the image forming process of the third page, and so forth.

(1) Dynamic Correction Process

[Issuing Condition 1-1]

The instruction is issued from the operation unit 46 by a user or the instruction is issued from the external computer (execution timing: immediate execution).

(2) Static Correction Process

[Issuing Condition 2-1]

The cover 2A is opened (execution timing: immediate execution).

[Issuing Condition 2-2]

When the power of the printer 1 is turned on, a first reference time (for example, 2 hours) or more has elapsed from the time of the execution of the previous static correction process (execution timing: immediate execution).

[Issuing Condition 2-3]

Continuous printing is maintained for s second reference time (for example, 30 minutes) or more (execution timing: pre-page execution).

In addition, the continuous printing includes, for example, the case where the image forming processes are continuously performed on the plurality of sheets 3, and the case where the number of sheets 3 on which the image forming processes are executed is a predetermined number of sheets or more within a prescribed time.

[Issuing Condition 2-4]

Intermittent printing is continued for a third reference time (for example, 2 hours) or more (execution timing: pre-page execution).

In addition, the intermittent printing includes, for example, the case where the image forming processes are intermittently performed on the plurality of sheets 3, and the case where the number of sheets 3 on which the image forming processes are executed is less than the predetermined number of sheets within the prescribed time.

[Issuing Condition 2-5]

The instruction is issued from the operation unit 46 by a user, the instruction is issued from the external computer (execution timing: immediate execution).

(3) Development Bias Correction Process

[Issuing Condition 3-1]

From the time of the execution of the previous development bias correction process, a fourth reference time (for example, 24 hours) or more has elapsed (execution timing: pre job execution).

[Issuing Condition 3-2]

A thermal sensor, which is not shown in the drawing, detects that a temperature within the printer 1 is changed to be a prescribed value or more (execution timing: pre-job execution).

[Issuing Condition 3-3]

By means of a new cartridge detection sensor, which is not shown in the drawing, at least one developing cartridge 22 is exchanged for a new one (execution timing: immediate execution).

(4) Gamma Correction Process

[Issuing Condition 4-1]

The instruction is issued from the operation unit 46 by a user, the instruction is issued from the external computer (execution timing: immediate execution).

Prescribed Order of Correction Process

In the embodiment, the preferable prescribed order of the correction processes is as follows.

First: development bias correction process

Second: gamma correction process

Third: dynamic correction process

Fourth: static correction process

When the densities of the patterns are mismatched, even if the marks are formed on the same image formation position, the light receiving amounts corresponding to the marks in the pattern detecting sensor 15 are changed before and after the mismatch of the densities. Hence, the detection positions of the marks are deviated, and from this result, it becomes difficult to precisely detect an amount of the deviation in image formation position. As a result, it is preferable that the development bias correction process be executed prior to the dynamic correction process and the static correction process.

Further, it is preferable that the gamma correction process be executed after the inner density deviation of the printer 1 is corrected by the development bias correction process. As a result, it is preferable that the gamma correction process be executed right after the development bias correction process.

Further, unless the deviation in dynamic image formation position is corrected, it is difficult to measure the deviation in static image formation position. Therefore, it is preferable that the static correction process be executed after the dynamic correction process. Additionally, the setting of the prescribed order may be changed by the instruction issued from the operation unit 46 by a user and the instruction issued from the external computer.

Issuing Process

The CPU 40 monitors which one of the plurality of issuing condition is satisfied at stated periods, and executes the execution request of the correction process, which satisfies the issuing condition, to be executed at an execution timing corresponding to the issuing condition. Specifically, a flag of the request for the issuing process is recorded on, for example, the NVRAM 43. At this time, the CPU 40 functions as the "issuing unit" according to the aspect of the invention.

Correction Control Process

FIG. 5 is a flowchart illustrating a correction control process. When the power of the printer 1 is turned on, the CPU 40 executes the correction control process at stated periods. In the correction control process, when another correction process is not issued at the execution timing of one correction process of which the execution request is issued, only the one correction process is executed. In addition, when the another correction process is issued, the one correction process and the another correction process are executed in a prescribed order regardless of the order of the execution timings and the issuing order of the execution requests.

Specifically, the CPU 40 determines whether the image formation instruction exists in step S1. The image formation instruction is based on, for example, the instruction issued from the operation unit 46 by a user and the instruction issued from the external computer. If there is no image formation instruction (S1: NO), the flow proceeds to step S3.

In step S3, it is determined whether the execution request of the "immediate execution" is issued. If the execution request is not issued (S3: NO), the flow returns to step S1. If the execution request of the immediate execution is issued (S3: YES), the flow proceeds to step S5.

In contrast, if there is the image formation instruction (S1: YES), it is determined in step S11 whether at least one of the "immediate execution" and the "pre-job execution" is issued. If it is issued (S11: YES), the flow proceeds to step S5. If it is not issued (S11: NO), the preliminary process of the image formation is executed in step S13. For example, a development process of the image data of the job corresponding to the image formation instruction and the like are executed, and the flow proceeds to step S15.

In step S15, it is determined whether at least one of the "immediate execution", the "pre-job execution" and the "pre-page execution" is issued. If it is issued (S15: YES), the flow proceeds to step S5. If it is not issued (S15: NO), the image forming process is executed on the basis of the image data in step S17. Then, if the image data includes a page on which the process is not performed (S19: YES), the flow returns to step S13. In contrast, if the entire page process is completed (S19: NO), the correction control process is terminated.

However, as described above, when any one of the execution timings of the "immediate execution", the "pre-job execution", and the "pre-page execution" comes, the flow proceeds to step S5. In step S5, it is determined whether there is a correction process (hereinafter, it is referred to as a "standby correction process") that the execution request is issued but should be on standby until the execution timing comes, other than a correction process (hereinafter, it is referred to as an "execution correction process") at the execution timing. Specifically, it is determined whether a different flag of the request for the issuing process is recorded on the NVRAM 43.

Furthermore, when the execution timing comes, the CPU 40 determines whether there is a correction process satisfying a more relaxed condition than the issuing condition (hereinafter, it is referred to as "pre-issuing correction process"). The relaxed condition is condition for detecting that the execution request will soon be issued. For example, a reference time of the issuing condition 2-2 may be set to be shorter than the first reference time, and a reference time of the issuing condition 2-3 may be set to be shorter than the second reference time. Further, a reference time of the issuing condition 3-1 may be set to be shorter than the fourth reference time, and a value of the issuing condition 3-2 may be set to be shorter than a prescribed value.

If any one of the standby correction process and pre-issuing correction process does not exist (S5: NO), the execution correction process is independently executed in step S9, and the correction control process is terminated. On the other hand, if any one of the standby correction process and pre-issuing correction process exists (S5: YES), the execution correction process, the standby correction process, and the pre-issuing correction process are executed in the prescribed order regardless of the issuing order of the execution request and the order of the execution timings in step S7, and the correction control process is terminated.

Figure 6:
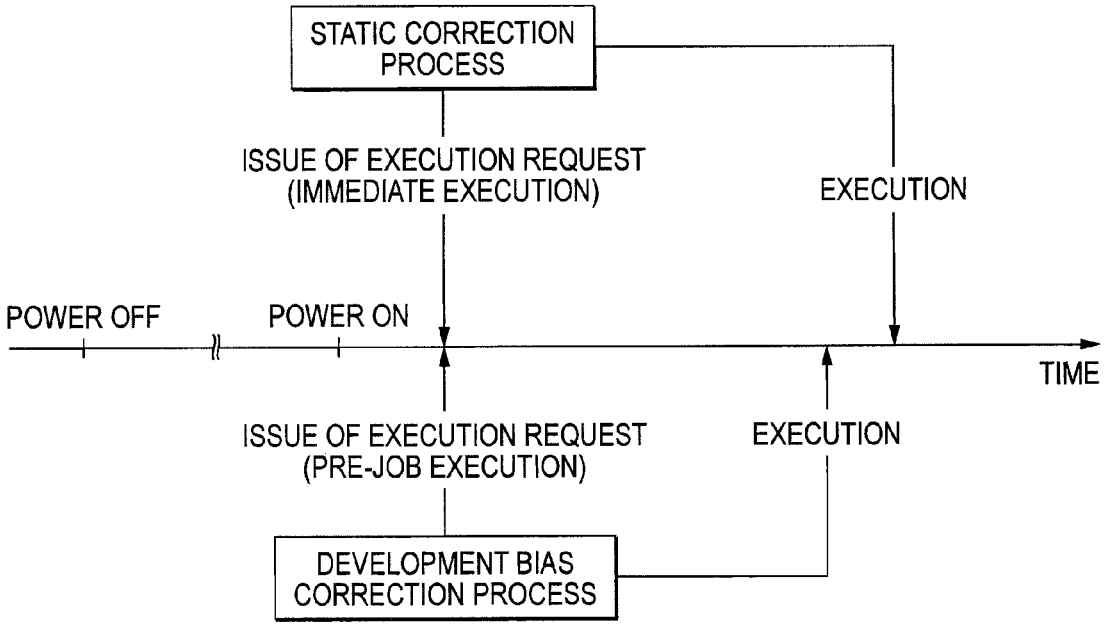
FIG. 6 is a time chart illustrating timings of execution and issue of execution requests of correction processes (Case 1)
Figure 7:
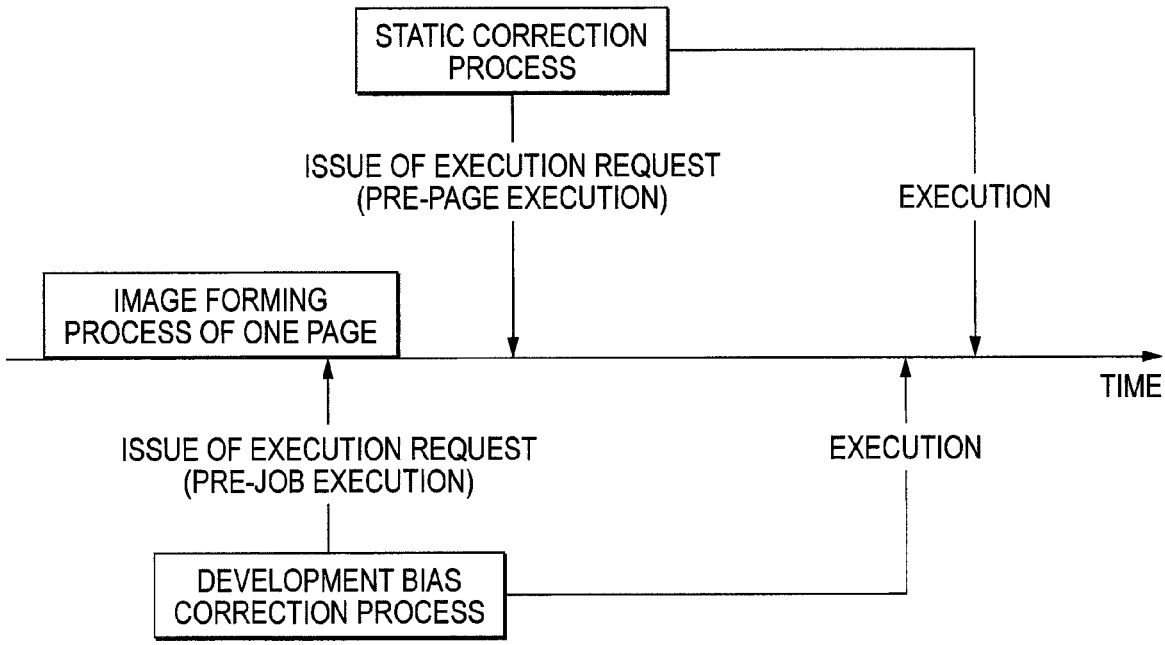
FIG. 7 is a time chart illustrating timings of execution and issue of execution requests of correction processes (Case 2).

FIGS. 6 and 7 are time charts illustrating timings of the execution and the issue of the execution requests of the correction process.

(1) Case 1

The case 1 is, as shown in FIG. 6, a case where the power of the printer 1 is turned off and the power is turned on after 24 hours has elapsed. In this case, to satisfy the issuing condition 2-2 of the static correction process, the execution request of the immediate execution of the static correction process is issued. Further, to satisfy the issuing condition 3-1 of the development bias correction process, the execution request of the pre-job execution of the development bias correction process is issued.

Here, in accordance with the execution timings of the execution requests, the static correction process is executed, and subsequently the development bias correction process is executed. However, in the configuration, there is a concern that the precision of the static correction process may be lowered by the density deviation of the pattern P2 as described above.

Accordingly, in the embodiment, the execution request of the immediate execution exists (S3: YES), it is determined whether there is the standby correction process or the pre-issuing correction process. In this case, the development bias correction process serves as the standby correction process. Therefore, in accordance with the prescribed order, first the development bias correction process is executed, and successively the static correction process is executed. In such a manner, it is possible to precisely execute the static correction process.

(2) Case 2

The case 2 is, as shown in FIG. 7, a case where the following condition is satisfied: the continuous printing is maintained for 30 minutes or more in a state where it is detected that the inner temperature of the printer 1 is changed to be a prescribed value or more and in the course of the job of performing the image forming process on the plurality of pages. In this case, to satisfy the issuing condition 2-3 of the static correction process, the execution request of the pre-page execution of the static correction process is issued. Further, to satisfy the issuing condition 3-2 of the development bias correction process, the execution request of the pre-job execution of the development bias correction process is issued.

Here, in accordance with the execution timings of the execution requests, the static correction process is executed before the image forming process (S17) of the next page, but the development bias correction process is not executed unless the image forming process is started for the next job. However, in the configuration, there is a concern that the precision of the static correction process may be lowered by the density deviation of the pattern P2 as described above.

Accordingly, in the embodiment, the execution request of the pre-page execution exists (S15: YES), it is determined whether there is the standby correction process or the pre-issuing correction process. In this case, the development bias correction process serves as the standby correction process. Therefore, in accordance with the prescribed order, first the development bias correction process is executed, and successively the static correction process is executed. In such a manner, it is possible to precisely execute the static correction process.

Advantage of the Embodiment (1) According to the embodiment, the correcting unit executes only one correction process, of which the execution request is issued, when another correction process is not issued at the execution timing of the one correction process. With such a configuration, it is possible to suppress the execution of unnecessary correction processes. Further, the correcting unit executes the one correction process and the another correction process in the prescribed order regardless of the execution timings indicated by the execution requests when the another correction process is issued at the execution timing of the one correction process. With such a configuration, it is possible to suppress the execution of the plurality of correction processes departing from the prescribed order.

(2) In the CPU 40, it is regarded that the execution request of the correction process satisfying a more relaxed condition than the issuing condition is being issued. With such a configuration, for example, it is possible to execute processes including the correction process which will soon satisfy the issuing condition in the prescribed order. For example, at the execution timing of the static correction process, the execution request of the dynamic correction process may be issued, and the development bias correction process may not satisfy the issuing condition but satisfy the relaxed condition. In this case, the CPU 40 executes the development bias correction process, the dynamic correction process, and the static correction process in this order, in accordance with the prescribed order.

Other Embodiments

The invention is not limited to the embodiment described by the above-mentioned techniques and drawings. For example, the scope of the invention may involve the following variations. In particular, among the components of the embodiment, components other than highest priority components of the invention are additional components, and thus may properly be omitted.

(1) In the embodiment, the prescribed order is an order of improving the precision of at least any one of the one correction process and the another correction process, but the invention is not limited to this. For example, by setting the order to be an order of short necessary time, it may be possible to complete as many correction processes as possible when the power of the printer 1 is turned off or an error occurs in the course thereof. Further, the order desired by a user may be used.

(2) In the embodiment, the development bias correcting is described as an example of a method of correcting the density of the pattern, but the invention is not limited to this. For example, it may possible to change an exposure intensity of the exposure unit, a transfer bias, a dither matrix pattern of the image data, and the like.

(3) In the embodiment, the invention is applied to the direct tandem type printer, but the invention may be applied to other type image forming apparatuses such as an intermediate transfer type printer and an ink jet type printer. Further, in the embodiment, the belt is used as the carrier for forming the pattern for detection, but other members may be used which includes a photosensitive drum, a photosensitive belt, an intermediate transfer belt, an intermediate transfer drum, a transfer drum, and the like.

As described above, according to an first illustrative aspect of the present invention, there is provided an image forming apparatus comprising: a carrier; a forming unit that forms a pattern on the carrier; a correcting unit that executes a plurality of correction processes for image formation by measuring the pattern formed on the carrier by the forming unit; and an issuing unit that has issuing conditions corresponding to the correction processes and issues execution requests indicating execution timings of the correction processes satisfying the issuing conditions, wherein the correcting unit executes only one correction process, of which the execution request is issued, when another correction process is not issued at the execution timing of the one correction process, and wherein the correcting unit executes the one correction process and the another correction process in a prescribed order regardless of the execution timings indicated by the execution requests when the another correction process is issued at the execution timing of the one correction process.

According to the first aspect of the invention, the correcting unit executes only one correction process, of which the execution request is issued, when another correction process is not issued at the execution timing of the one correction process. With such a configuration, it is possible to suppress the execution of unnecessary correction processes. Further, the correcting unit executes the one correction process and the another correction process in the prescribed order regardless of the execution timings indicated by the execution requests when the another correction process is issued at the execution timing of the one correction process. With such a configuration, it is possible to suppress the execution of the plurality of correction processes departing from the prescribed order.

According to the second aspect of the present invention, in addition to the first aspect of the invention, it is preferable that the prescribed order be an order of improving a precision of at least any one of the one correction process and the another correction process.

According to the second aspect of the invention, it is possible to improve the precision in correction.

According to the third aspect of the present invention, in addition to the first aspect of the present invention, the correcting unit performs, in the prescribed order, at least the one correction process and the correction process satisfying a more relaxed condition than the issuing condition at the execution timing of the one correction process. According to the aspect of the invention, in the correcting unit, it is regarded that the execution request of the correction process satisfying a more relaxed condition than the issuing condition is being issued. With such a configuration, for example, it is possible to execute processes including the correction process which will soon satisfy the issuing condition in the prescribed order.

According to the fourth aspect of the present invention, in addition to the first aspect of the present invention, the plurality of correction processes includes a process of correcting a density and a process of correcting deviation in an image formation position, and wherein the process of correcting the density precedes the process of correcting the deviation in the image formation position in the prescribed order.

According to the fourth aspect of the invention, by executing the density correction process first, the density is corrected to be an appropriate value. Thus, it is possible to suppress deterioration in precision of the correcting of the deviation in image formation position executed after the density correction process.

According to the fifth aspect of the present invention, in addition to the first aspect of the present invention, the plurality of correction processes includes a dynamic correcting of the deviation in the image formation position and a static correcting of the deviation in the image formation position, and wherein the dynamic correcting of the deviation in the image formation position precedes the static correcting of the deviation in image formation position in the prescribed order.

According to the fifth aspect of the present invention, first the dynamic correcting of the deviation in image formation position is executed, and then the static correcting of the deviation in image formation position is executed. Thus, it is possible to suppress deterioration in precision of the static correcting of the deviation in image formation position.

According to the above described aspect of the invention, it is possible to execute a plurality of correction processes independent of each other while suppressing departing from a prescribed order.

What is claimed is:

1. An image forming apparatus comprising:

a carrier;

a forming unit that forms a pattern on the carrier;

a correcting unit that executes a plurality of correction processes for image formation by measuring the pattern formed on the carrier by the forming unit; and an issuing unit that has issuing conditions corresponding to the correction processes and issues execution requests indicating execution timings of the correction processes satisfying the issuing conditions, wherein the correcting unit executes only one correction process, of which the execution request is issued, when another correction process is not issued at the execution timing of the one correction process, and wherein the correcting unit executes the one correction process and then the another correction process in a prescribed order regardless of the execution timings indicated by the execution requests when the another correction process is issued at the execution timing of the one correction process.

2. The image forming apparatus according to claim 1, wherein the prescribed order is an order of improving a precision of at least any one of the one correction process and the another correction process.

3. The image forming apparatus according to claim 1, wherein the correcting unit performs, in the prescribed order, at least the one correction process and the correction process satisfying a more relaxed condition than the issuing condition at the execution timing of the one correction process.

4. The image forming apparatus according to claim 1, wherein the plurality of correction processes includes a process of correcting a density and a process of correcting deviation in an image formation position, and wherein the process of correcting the density precedes the process of correcting the deviation in the image formation position in the prescribed order.

5. The image forming apparatus according to claim 1, wherein the plurality of correction processes includes a dynamic correcting of the deviation in the image formation position and a static correcting of the deviation in the image formation position, and wherein the dynamic correcting of the deviation in the image formation position precedes the static correcting of the deviation in image formation position in the prescribed order.

* * * * *